United States Patent [19]

Chaconas et al.

[11] Patent Number: 4,998,454

[45] Date of Patent: Mar. 12, 1991

[54] SCREWDRIVER BIT FOR PHILLIPS-HEAD FASTENERS

[75] Inventors: Peter C. Chaconas, Glyndon; Paul A. Stone, Westminster, both of Md.

[73] Assignee: Black & Decker Inc., Newark, Del.

[21] Appl. No.: 439,603

[22] Filed: Nov. 20, 1989

Related U.S. Application Data

[63] Continuation-in-part of Ser. No. 270,000, Nov. 14, 1988, abandoned.

[51] Int. Cl.[5] ..... B25B 23/00

[52] U.S. Cl. ..... 81/460; 81/436

[58] Field of Search ..... 81/460, 436

[56] References Cited

U.S. PATENT DOCUMENTS

| | | | |
|---|---|---|---|
| Re. 24,888 | 10/1960 | Smith et al. . | |
| 2,046,837 | 7/1936 | Phillips . | |
| 2,046,838 | 7/1936 | Phillips . | |
| 2,046,840 | 7/1936 | Phillips et al. . | |
| 2,389,129 | 11/1945 | Bishop . | |
| 2,402,342 | 6/1946 | Phillips . | |
| 2,474,994 | 7/1949 | Tomalis . | |
| 2,507,231 | 5/1950 | Tomalis . | |
| 2,592,462 | 4/1952 | Phipard, Jr. . | |
| 2,601,453 | 6/1952 | Phipard, Jr. . | |
| 2,646,829 | 7/1953 | Phipard, Jr. . | |
| 2,764,197 | 9/1956 | Torresen . | |
| 2,847,894 | 8/1958 | Smith et al. . | |
| 2,859,782 | 11/1958 | Cummaro . | |
| 3,037,539 | 6/1962 | Johnson et al. . | |
| 3,108,623 | 10/1963 | Muenchinger . | |
| 3,170,364 | 2/1965 | Johnson et al. . | |
| 3,234,982 | 2/1966 | Stillwagon, Jr. . | |
| 3,654,974 | 4/1972 | Barnes . | |
| 3,658,105 | 4/1972 | Burt et al. . | |
| 3,913,647 | 10/1975 | Arnn | 81/460 |
| 4,084,478 | 4/1978 | Simmons . | |
| 4,089,357 | 5/1978 | Gill . | |
| 4,187,892 | 2/1980 | Simmons . | |
| 4,355,552 | 10/1982 | Gutshall . | |
| 4,464,957 | 8/1984 | Gill . | |
| 4,625,598 | 12/1986 | Wolfram . | |

FOREIGN PATENT DOCUMENTS

| | | |
|---|---|---|
| 8021734 | of 0000 | Fed. Rep. of Germany . |
| 1330358 | 5/1962 | France . |
| 2383350 | 6/1978 | France . |
| 2469250 | 12/1979 | France . |
| 813571 | of 0000 | United Kingdom . |
| 901417 | of 0000 | United Kingdom . |
| 1065348 | of 0000 | United Kingdom . |
| 1102404 | of 0000 | United Kingdom . |

OTHER PUBLICATIONS

The Wall Street Journal, article "Does Henry Phillips, Bane of Handymen, Really Rest in Peace", Sep. 15, 1988.

*Primary Examiner*—Frederick R. Schmidt
*Assistant Examiner*—Lawrence Cruz
*Attorney, Agent, or Firm*—Harness, Dickey & Pierce

[57] ABSTRACT

A modified Phillips-type screwdriver bit is disclosed that is fully compatible with a standard Phillips-head fastener, and is designed to significantly increase the level of torque that can be applied to the fastener while at the same time substantially reducing the cam-out forces normally produced by a standard Phillips screwdriver bit. These results are accomplished by forming generated surfaces along the side walls of the bit wings so that when the bit is initially inserted into a standard Phillips-head fastener, lines of contact occur between the bit and recess adjacent and parallel to the roots of the bit wings. In this manner, the application of torque is confined to the sides of the bit wings even as applied torque levels increase.

72 Claims, 7 Drawing Sheets

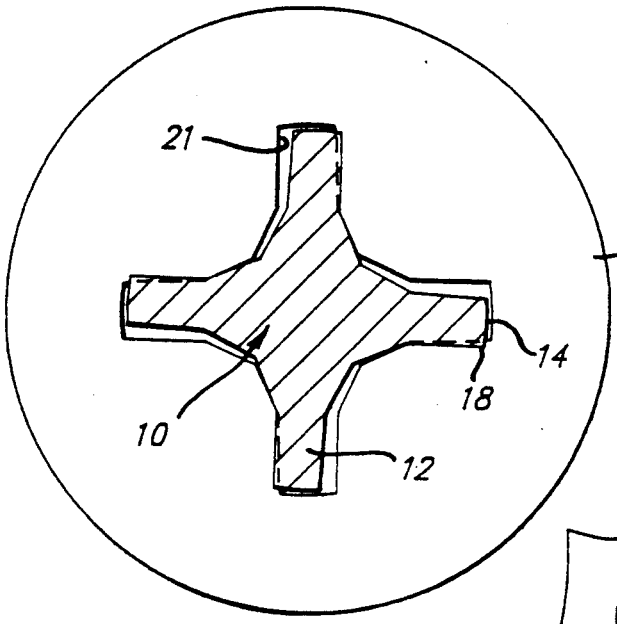
FIG. 14.
FIG. 15.
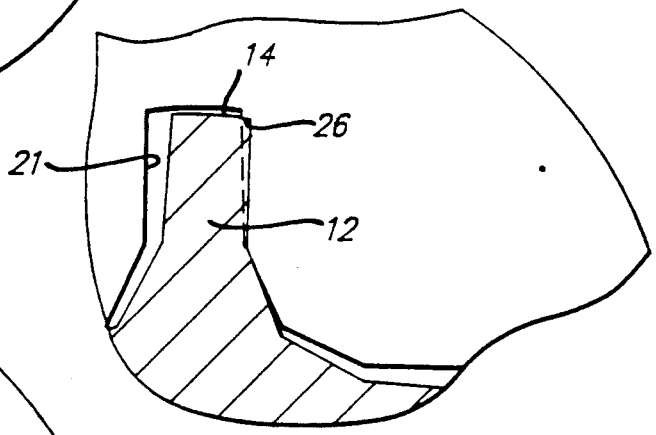
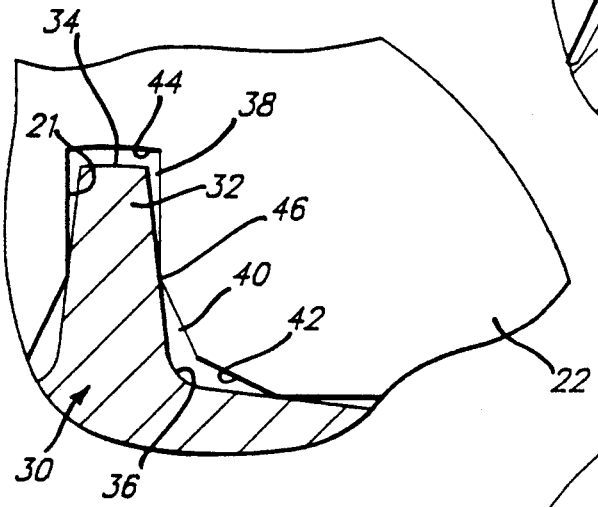
FIG. 25.
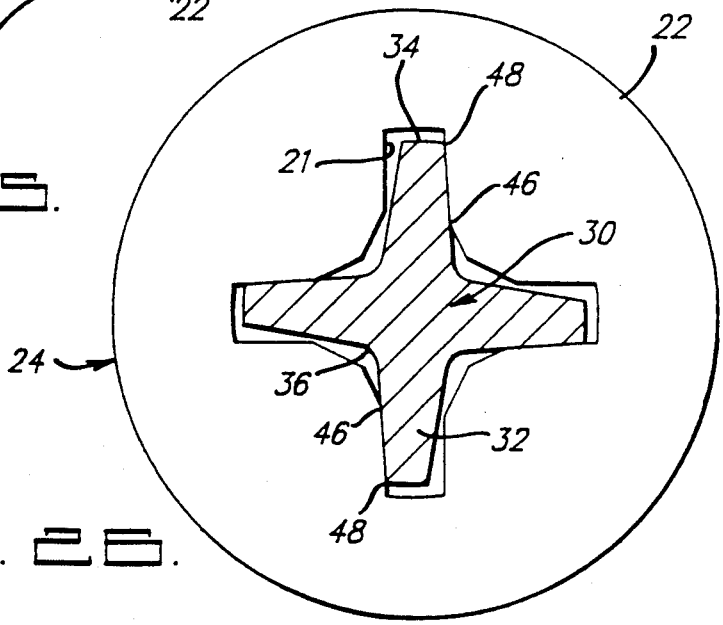
FIG. 26.

SCREWDRIVER BIT FOR PHILLIPS-HEAD FASTENERS

CROSS-REFERENCE TO RELATED APPLICATION

This application is a continuation-in-part of U.S. application Ser. No. 270,000, filed Nov. 14, 1988, now abandoned.

BACKGROUND AND SUMMARY OF THE INVENTION

The present invention relates to screwdriver bits and in particular to an improved screwdriver bit for Phillips-head fasteners that significantly reduces the "cam-out" experienced with a conventional screwdriver bit for Phillips-head fasteners.

Conventional Phillips-head fasteners and screwdrivers were originally developed to provide a fastening system that would facilitate efficient installation of fasteners on an assembly line. In particular, as compared to conventional slotted screws, the Phillips screw was designed to center quickly and easily on the screwdriver and permit more torque to be applied to the screw so that it would hold tighter than conventional slotted screws. In addition, it was expressly contemplated that, when applied by automated screwdrivers on an assembly line, the increasing torque applied to the Phillips screw would eventually cause the driver to pop out of the recess in the screw. In other words, the original Phillips-head design was intended to cause cam-out of the driver without damaging the screw head. It is, of course, this tendency of the Phillips-head design to cause cam-out of the driver, that is a principal source of irritation for craftsmen and ordinary consumers alike.

It is, therefore, the primary object of the present invention to provide an improved screwdriver bit that is compatible with the standard Phillips-head geometry and, therefore, is useable with standard Phillips-head fasteners and yet is designed to significantly reduce the tendency of the driver to cam-out of the recess in the screw head.

In addition, it is an object of the present invention to provide an improved driver for Phillips-head screws that enables the application of significantly greater torque loads to a standard Phillips-head screw with minimum distortion of the shape of the recess in the screw head.

Furthermore, it is an object of the present invention to provide an improved driver for Phillips-head screws that enables the application of significantly greater torque loads to a standard Phillips-head screw equally in both rotational directions.

It is also an object of the present invention to provide such an improved Phillips-type screwdriver bit that retains the other benefits of the standard Phillips system, namely the automatic centering of the bit on the fastener, the "fit" of bit to the fastener, and the ability to hold a fastener on the end of the bit prior to installation.

Additional objects and advantages of the present invention will become apparent from a reading of the following detailed description of the preferred embodiment which makes reference to the drawings in which:

BRIEF DESCRIPTION OF THE DRAWINGS

FIG. 14 is a sectional view of a standard Phillips fastener system illustrating the deformation of the recess in the head of the fastener;

FIG. 15 is a enlarged view of one of the outer radial wing sections shown in FIG. 14;

FIG. 25 is an enlarged view of one of the wing sections of the Phillips-type fastening system according to the present invention;

FIG. 26 is a sectional view similar to FIG. 24 showing the screwdriver bit applying maximum torque to the fastener;

DETAILED DESCRIPTION OF THE PREFERRED EMBODIMENT

Figure 1:
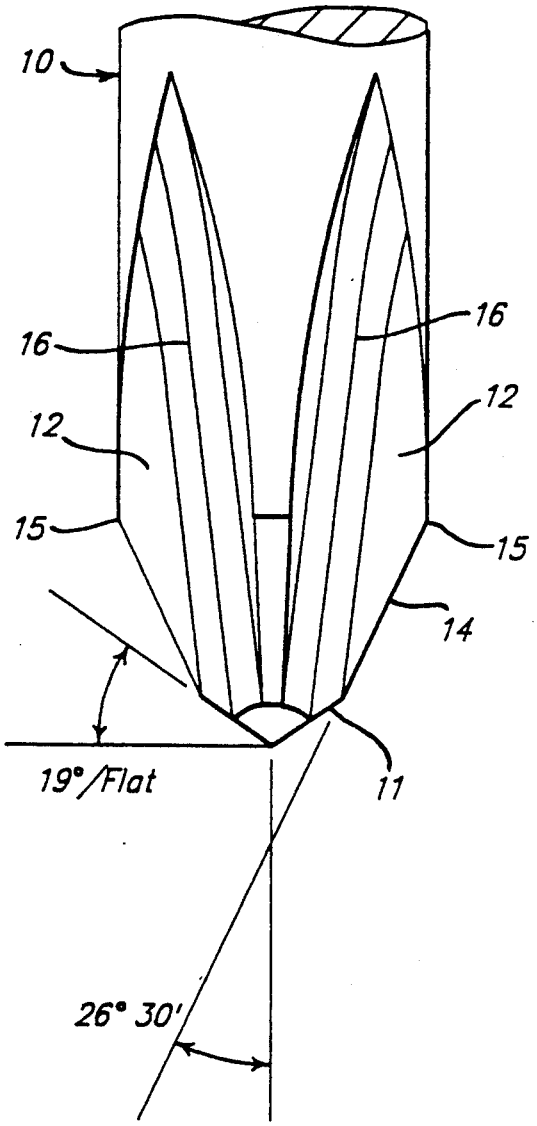
FIG. 1 is a side elevational view of a standard screwdriver bit for Phillips-head screws.
Figure 2:
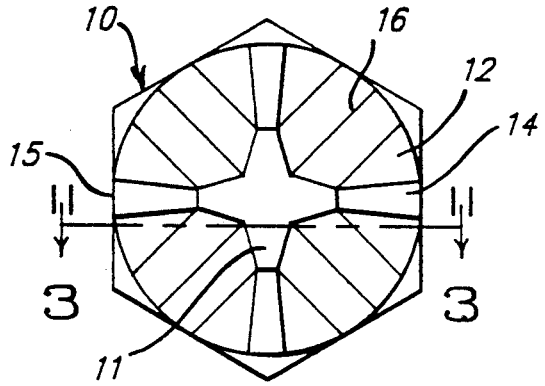
FIG. 2 is an end view of the Phillips bit shown in FIG. 1.
Figure 3:
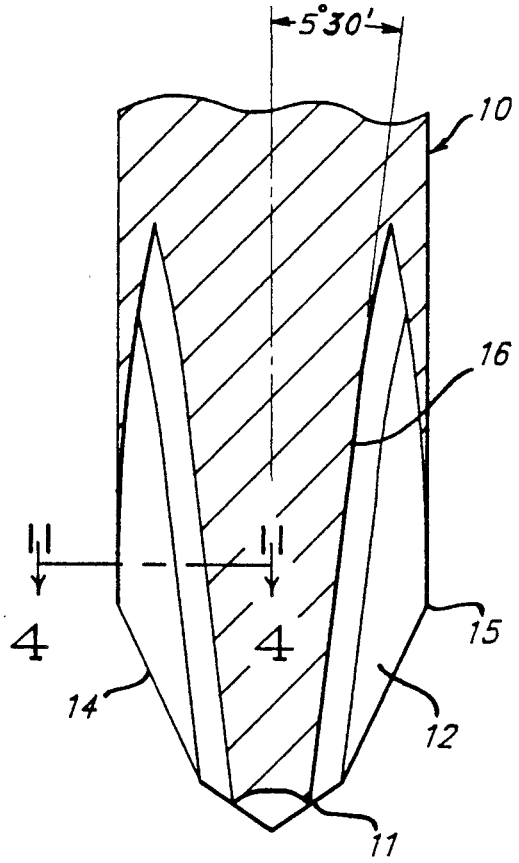
FIG. 3 is a sectional view taken along line 3—3 in FIG. 2.
Figure 4:
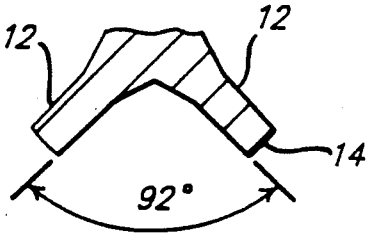
FIG. 4 is a partial sectional view taken along line 4—4 in FIG. 3.
Figure 5:
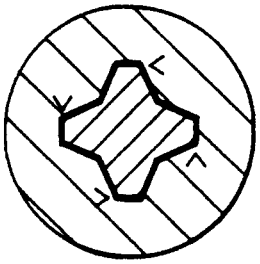
FIGS. 5–11 comprise a progressive series of sectional views of a standard Phillips-type bit and screw fastening system starting from the base of the wings of the screwdriver bit in FIG. 5 to the top of the head of the fastener in FIG. 11.
Figure 6:
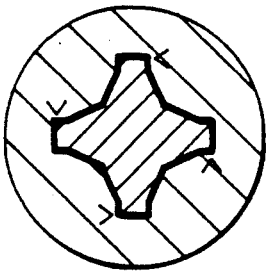
Figure 7:
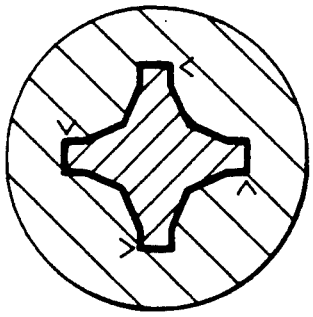
Figure 8:
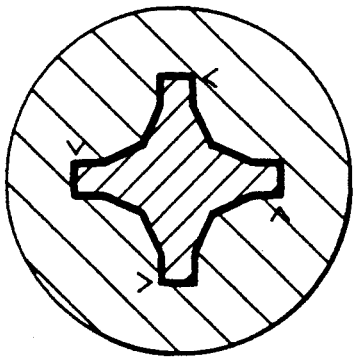
Figure 9:
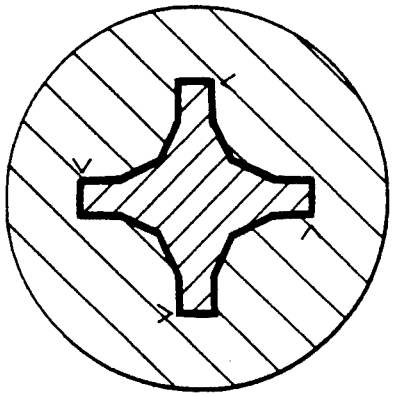
Figure 10:
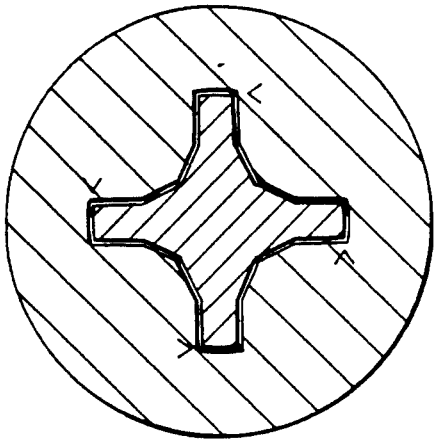
Figure 11:
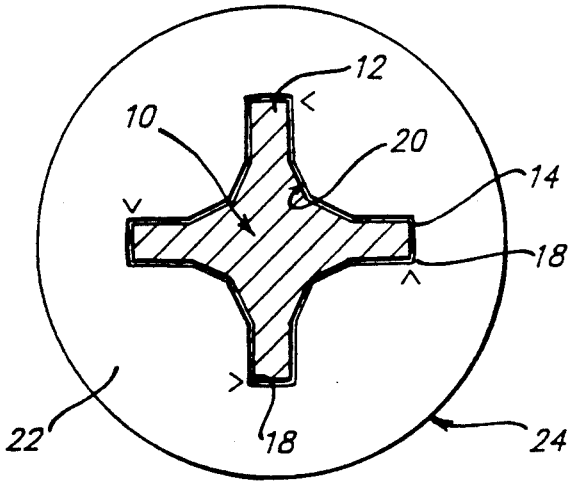

The structure, significance, and advantages of the present invention are believed best understood if described in relation to a standard Phillips screwdriver bit. Accordingly, FIG. 1 in the drawings illustrates a standard No. 2 Phillips bit 10 and will be used as a starting point for the description of the present invention. A standard Phillips bit 10 has a cross-shaped tip that is formed through the creation of four wedge-shaped concave recesses that converge toward the tip 11 of the bit. The recesses define four evenly spaced wings 12 that are tapered along their outer radial surfaces 14 toward the tip of the bit. The angle of this taper is referred to as the "wing angle" and in a standard No. 1, 2, or 3 Phillips bit is equal to 26 degrees 30 minutes relative to the vertical axis of the bit. The radially innermost part 16 of each recess is referred to as the "root" 16 and the angle at which the root diverges from the tip relative to the axis of the bit is referred to as the "root angle". In a standard No. 2 Phillips bit, the root angle of that portion of the bit 10 adapted to engage the fastener is 5 degrees 30 minutes, as shown in FIG. 3. The root angle in a standard No. 3 Phillips bit is also 5 degrees 30 minutes; however, the root angle is 7 degrees in a standard No. 1 Phillips bit. Additionally, as best illustrated in FIG. 4, the angle formed by the adjoining interior wing surfaces 18, referred to as the "included angle", is 92 degrees in a standard No 1, 2, or 3 Phillips bit and remains constant along the entire axial length of the bit wings 12. Finally, the tip 11 of a standard Phillips bit is conically shaped as shown in FIG. 1 to form a point, the conical surface diverging from the point at an angle of 19 degrees relative to the plane normal to the axis of the bit The specifications and dimensions for standard Phillips-type bits are defined in literature published by the Screw Research Association.

Given the above geometry for a standard Phillips bit 10, it is important to bear in mind, as shown in FIGS. 5–11, that the cross-shaped recess 20 formed in the head 22 of a standard Phillips-head fastener 24 is created with a punch having precisely the same dimensional characteristics. Accordingly, the standard Phillips screwdriver bit 10 is adapted to fit precisely into the recess 20 formed in the head 22 of a standard Phillips fastener 24, except for a designed-in tolerance clearance which enables the bit to fit readily into the recess 20. This relationship is clearly demonstrated in FIGS. 5–11 which comprise sectional views of a standard Phillips-type fastening system progressing in the axial direction from the base of the bit wings 12 in FIG. 5 to the top of the head 22 of the fastener 24 in FIG. 11.

In view of the precise conformity between the driver 10 and the recess 20 in the head 22 of the fastener in a standard Phillips-type fastening system, it will be appreciated that as the screwdriver bit 10 is rotated in the clockwise direction, torque is applied to the head 22 of the fastener 24 along the outer radial edges 18 of the bit wings 12, as indicated by the arrows appearing in FIGS. 5–11. This occurs due to the simple geometric fact that the points farthest from the center of rotation move the greatest distance. Therefore, assuming a substantially uniform tolerance gap between the bit 10 and the recess 20, the outer radial edges 18 of the bit wings 12 will take up the tolerance gap first and engage the opposing outer recess wing surfaces, establishing lines of contact therealong. The concentration of torque along the outer radial edges 18 of the bit wings 12 results in the recess wings 21 in the head 22 of the fastener 24 deforming in these areas as torque levels increase. This deformation is illustrated in somewhat exaggerated form in FIGS. 14 and 15. Once this deformation occurs, the radially outward facing end surfaces 14 of the bit wings 12 come into contact with the newly formed opposing surfaces 26 in the deformation areas, thereby generating a significant force in the vertical direction (i.e., out of the paper relative to FIGS. 14 and 15) causing the driver 10 to "cam out" of the screw-head recess 20.

Figure 12:
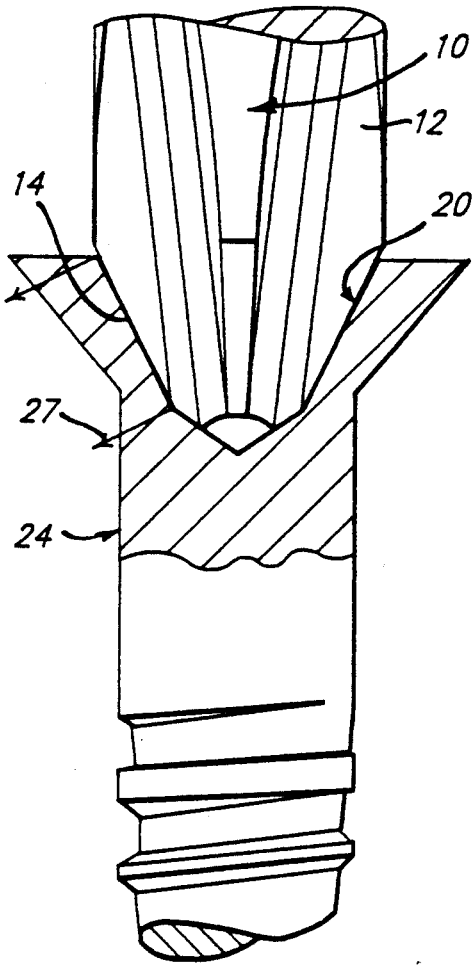
FIG. 12 is a side elevational view partially in section of a standard Phillips fastening system.
Figure 13:
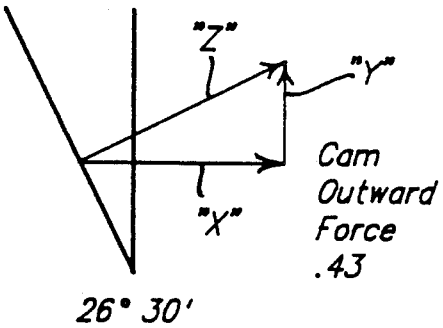
FIG. 13 is a force vector diagram illustrating the cam-out force component generated by the standard Phillips fastener system.

This phenomenon is illustrated and the related force vectors diagrammed in FIGS. 12 and 13. In particular, as the torque applied along the outer radial edges 18 (FIG. 11) of the bit wings 12 increases and deformation of the outer radial areas of the recess wings 21 occur, a force is generated by the radially outward facing end surfaces 14 of the bit wings 12 against the deformed surfaces 26 of the recess wings 21 in a direction normal to the end surfaces 14, as indicated by the arrows 27 in FIG. 12. This, in turn, creates an equal and opposite force from the deformed surfaces 26 against the radially outward facing wing surfaces 14. This opposing force, designated "Z" in the force diagram illustrated in FIG. 13 is comprised of a horizontal force component, designated "X", and a vertical force component, designated "Y". Given the Phillips-standard wing angle of 26 degrees 30 minutes, the resulting cam-out force, "Y", generated by the application of torque from the screwdriver bit 10 to the fastener 24 is equal to a factor of 0.43 (i.e., sin 26° 30′) times the magnitude of the force vector "Z". In other words, the greater the application of torque, the greater the force tending to cam the screwdriver bit 10 out of the recess 20 in the head 22 of the fastener 24.

Figure 16:
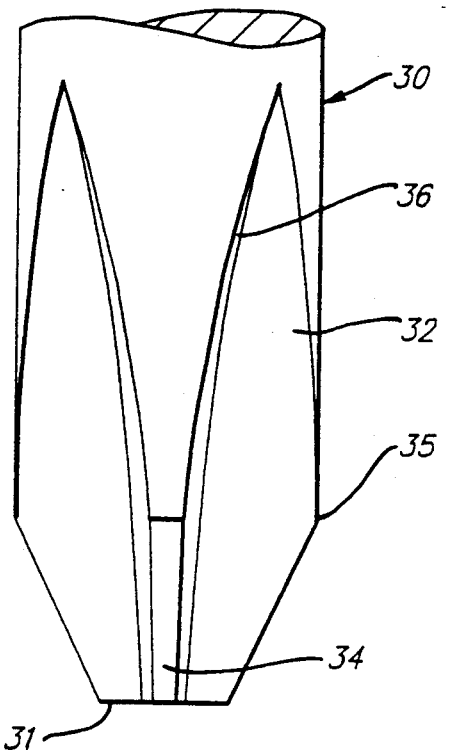
FIG. 16 is a side elevational view of a Phillips-type screwdriver bit according to the present invention.

To obviate this cam-out tendency of the standard Phillips fastening system, the improved Phillips-type screwdriver bit according to the present invention has been designed so that torque loading between the bit and the recess in the head of a standard Phillips fastener is confined to the side faces of the bit wings. This is accomplished in the manner described below. Referring now to FIG. 16, an improved Phillips-type screwdriver bit 30 according to the present invention is shown. At the outset it should be noted that the preferred embodiment of the present screwdriver bit 30 retains substantially the same root angle (either 5 degrees 30 minutes for a No. 2 or No. 3 Phillips fastener, or 7 degrees for a No. 1 Phillips fastener) and substantially the same wing angle of 26 degrees 30 minutes according to standard Phillips specifications to ensure that the present bit 30 is fully compatible with standard Phillips-head fasteners. However, as will become apparent to those skilled in the art, to ensure compatibility with standard Phillips fasteners, it is only necessary that the screwdriver bit according to the present invention possess a root angle and wing angle approximately equal to but not substantially greater than (within limits) the standard Phillips dimensions. Thus, it will be appreciated that the present invention does not require a uniquely configured fastener to achieve its increased torque loading capabilities. Moreover, due to the radial symmetry of the present screwdriver bit 30, the increased torque loading capabilities of the present invention apply equally in both rotational directions of the driver.

Returning to the drawings, it will be noted from an examination of FIG. 16 that the width of the radially outward facing surface 34 of the bit wing 32 remains substantially constant from the base 31 of the wing to the wing tip 35. This is contrary to the configuration of a standard Phillips bit, as illustrated in FIG. 1, whose corresponding surface 14 gradually increases in width from the base 11 of the wing 12 to the wing tip 15 due to the geometry of the Phillips-standard root angle and the constant Phillips-standard included angle. Specifically, the preferred embodiment of the Phillips-type bit 30 according to the present invention does not maintain a constant included angle from the base 31 of the wing 32 to the wing tip 35. Rather, the included angle between the bit wings 32 in the preferred embodiment of the present screwdriver bit 30 varies from the base 31 of the bit wings 32 to the wing tips 35. In other words, rather than the side surfaces of the bit wings 12 being defined by flat planes as in the standard Phillips bit 10, the side surfaces of the bit wings 32 in the present bit 30 comprise generated surfaces. Therefore, as used herein and in the claims, the term "generated surface" refers to the non-planar, curved surface characteristic of the bit wing sidewalls that results from the varying included angle between adjoining bit wings 32. This is demonstrated in FIGS. 17 and 30 which illustrate different embodiments of the present invention. In the embodiment illustrated in FIG. 17 the included angle between the bit wings 32 is equal to the Phillips-standard 92 degrees at the base 31 of the bit wings and progressively increases to approximately 105 degrees at the wing tips 35. In the embodiment illustrated in FIG. 30, the included angle between the bit wings 32 is equal to approximately 119 degrees at the base 31 of the bit wings and progressively decreases to approximately 110 degrees at the wing tips 35.

Figure 27:
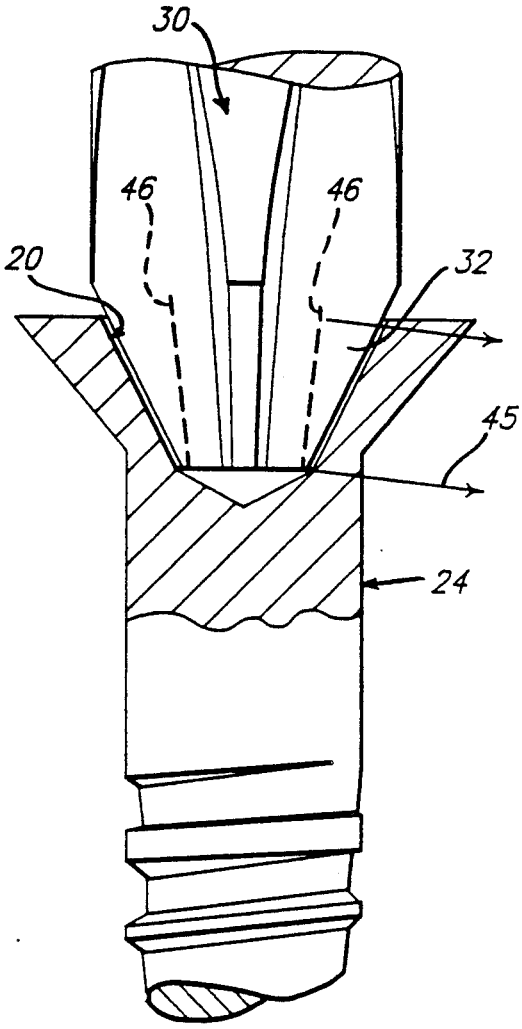
FIG. 27 is a side elevational view partially in section of the Phillips-type fastening system according to the present invention.
Figure 24:
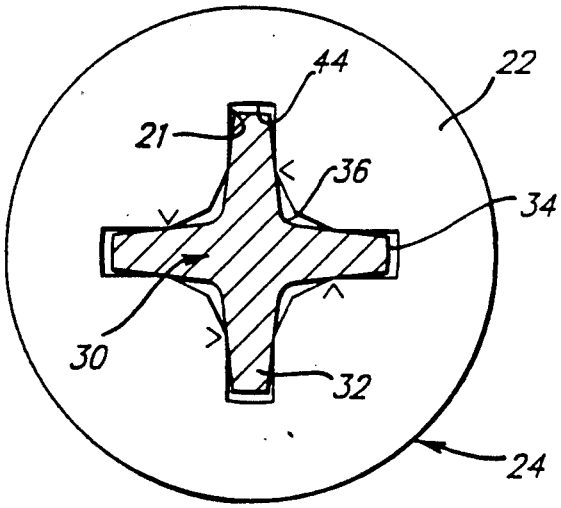

As a result, when the screwdriver bit 30 according to the present invention is inserted into the recess 20 of a standard Phillips-head fastener 24, a gradually increasing gap 38 (FIG. 25) is defined between the bit wings 32 and the recess wings 21 in the radially outward direction. This is due to the fact that the thickness of the recess wings 21 in the standard Phillips-head fastener 24 diminishes more gradually in the radially outward direction due to the constant Phillips-standard included angle, which is smaller than the included angle of the present bit 30. In other words, the gap 38 shown in FIGS. 24 and 25 results from the fact that the included angle between the sidewalls of the recess wings 21 corresponds to the Phillips-standard 92 degrees whereas the included angle between the bit wings 32 at this illustrated axial position of bit 30 corresponds to approximately 103 degrees in the embodiment shown in FIG. 17 and approximately 110 degrees in the embodiment shown in FIG. 30. (Note that the 103 degree and 110 degree angles referred to correspond to the included angle at an axial position somewhat below the wing tip 35 as the entire bit portion typically does not fit into the recess 20 in the head of the fastener 24, as shown in FIG. 27.) In addition, it is important to note that the radial dimension of the bit wings 32 when the bit is fully inserted into the recess 20 is less than that of the recess wings 21 so that a slight space is maintained between the radially outward facing surfaces 34 of the bit wings 32 and the opposing surfaces 44 of the recess wings 21 In the preferred embodiment of the present invention, the roots 36 of the recesses between adjoining bit wings 32 are also formed somewhat deeper so that an additional gap 40 (FIG. 25) is created between the root 36 of the bit 30 and the root 42 of the recess 20 in the standard Phillips-head fastener 24. Finally, as illustrated in FIGS. 16 and 27, the base 31 of the present screwdriver bit 30 is preferably truncated as shown to prevent the bit 30 from bottoming out when inserted into the recess 20 of a standard Phillips-head fastener 24.

Figure 29:
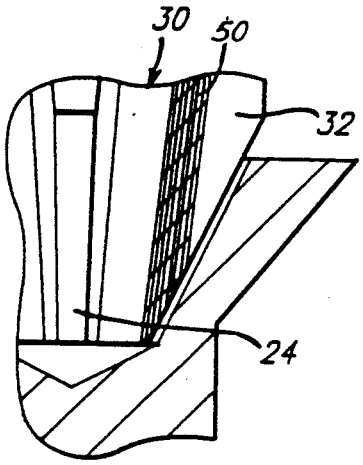
FIG. 29 is an enlarged side elevational view partially in section of one of the wing sections of the Phillips-type fastening system according to the present invention.

As a result of this configuration, when the present screwdriver bit 30 is inserted into the recess 20 of a standard Phillips-head fastener 24 and rotated in a clockwise direction, torque is applied to the fastener 24 initially along lines of contact 46 between the side surfaces of the bit wings 32 and the opposing side surfaces of the recess wings 20, as indicated by the arrows appearing in FIGS. 18–24. In addition, it will be appreciated that these initial lines of contact 46 between the side surfaces of the bit wings 32 and recess wings 20 are essentially parallel to the root 36 of the bit 30, as illustrated by the dashed lines in FIG. 27. In other words, these lines of contact 46 form substantially the same 5-degree 30-minute angle with respect to the axis of the bit 30 corresponding to the Phillips-standard root angle. Moreover, as the level of applied torque increases and the bit 30 begins to deform the recess 20, the lines of contact expand radially outwardly in parallel fashion along the side faces of the bit wings 32, as indicated by the shaded portion 50 illustrated in FIG. 29. This serves to significantly increase the level of torque that can be transmitted from the screwdriver bit 30 to the fastener 24 while confining the areas of engagement to the side surfaces of the bit wings 12. This distinction between the present invention and the standard Phillips bit is illustrated in FIGS. 14 and 26.

Figure 28:
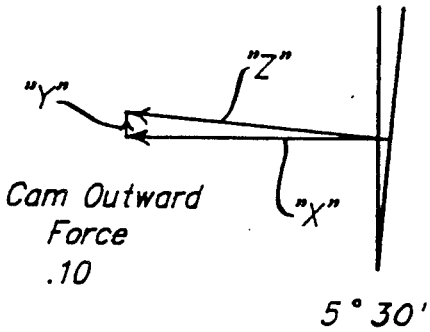
FIG. 28 is a force vector diagram illustrating the cam-out force component generated by the Phillips-type fastener system according to the present invention.

Significantly, by confining the areas of engagement and hence the deformation of the recess 20 to the sidewalls of the recess wings 21 as illustrated in FIG. 26, the cam-out forces generated by the increased application of torque to the fastener is minimized. Accordingly, driving engagement between the screwdriver bit 30 and the fastener 24 can easily be maintained with the application of a modest amount of downforce. This phenomenon of the present invention is illustrated and diagrammed in FIGS. 27 and 28. As previously noted, the application of torque from the bit 30 to the fastener 24 along the initial lines of contact 46 on the side surfaces of the bit wings 32 is represented by the dotted lines in FIG. 27. The application of force in this manner results in the generation of an outwardly directed force component perpendicular to the lines of contact, as indicated by the arrows 45 in FIG. 27. This, in turn, results in the generation of an equal and opposite force vector designated "Z" in the accompanying vector force diagram shown in FIG. 28. In view of the approximated 5-degree 30-minute angle of the force vector "Z" relative to the axis of the bit 30, the force vector "Z" is comprised predominantly of a horizontal force component, labeled "X", and a relatively small vertical force component, labeled "Y". In fact, the vertical force component "Y" tending to cause the bit 30 to cam-out of the recess 20 is only equal to approximately a factor of 0.10 (i.e., sin 5° 30′) times the magnitude of the force vector "Z". Accordingly, when compared to a standard Phillips bit 10, significantly less downward force is required from the operator to retain the present bit 30 in the recess 20 of a standard Phillips-head fastener 24, even at high levels of applied torque.

Figure 17:
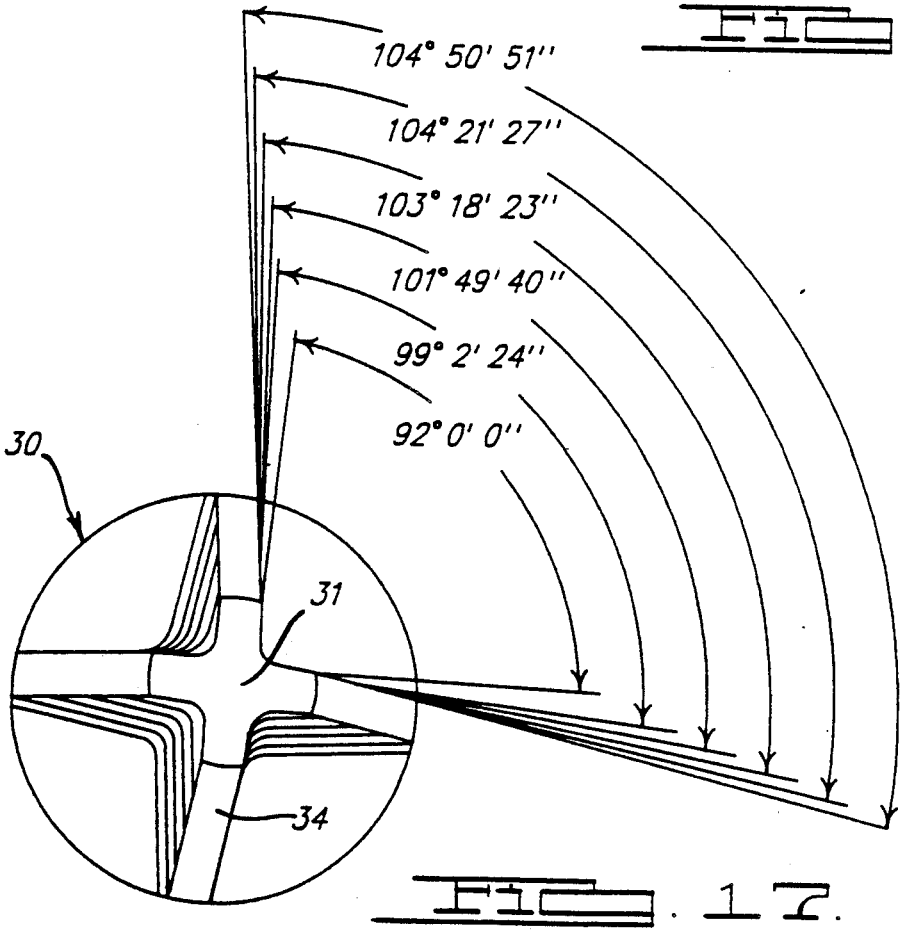
FIG. 17 is a simplified perspective view of the bottom end of one embodiment of the bit shown in FIG. 16.
Figure 18:
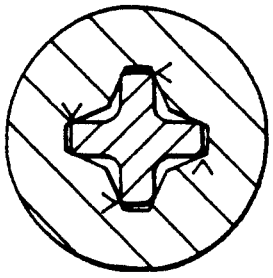
FIGS. 18–24 comprise a progressive series of sectional views of the Phillips-type fastening system according to the present invention from the base of the wings of the screwdriver bit in FIG. 18 to the top of the head of the fastener in FIG. 24.
Figure 19:
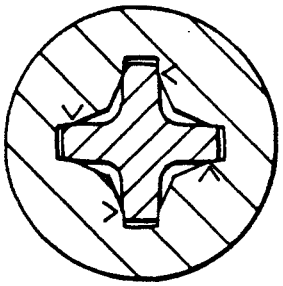
Figure 20:
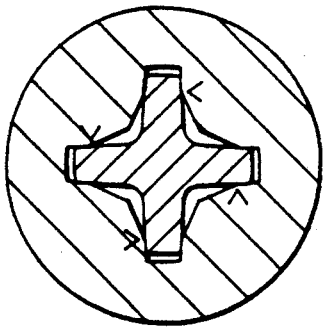
Figure 21:
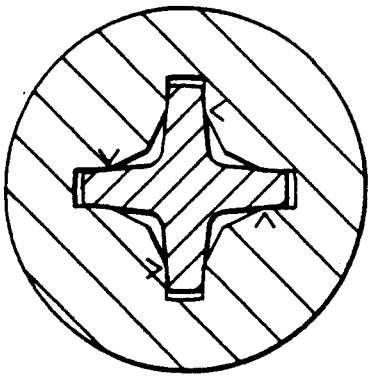
Figure 22:
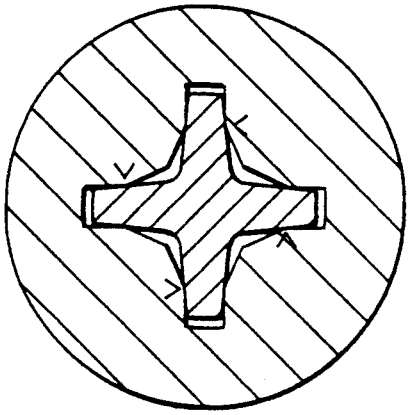
Figure 23:
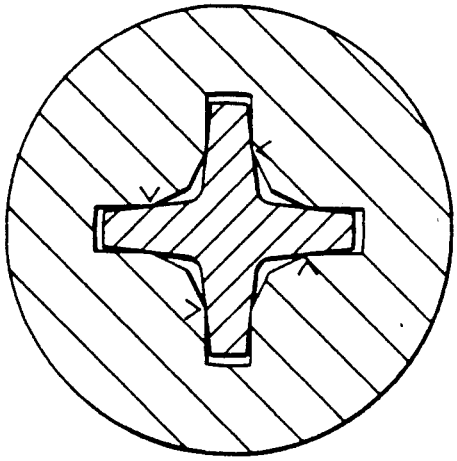
Figure 30:
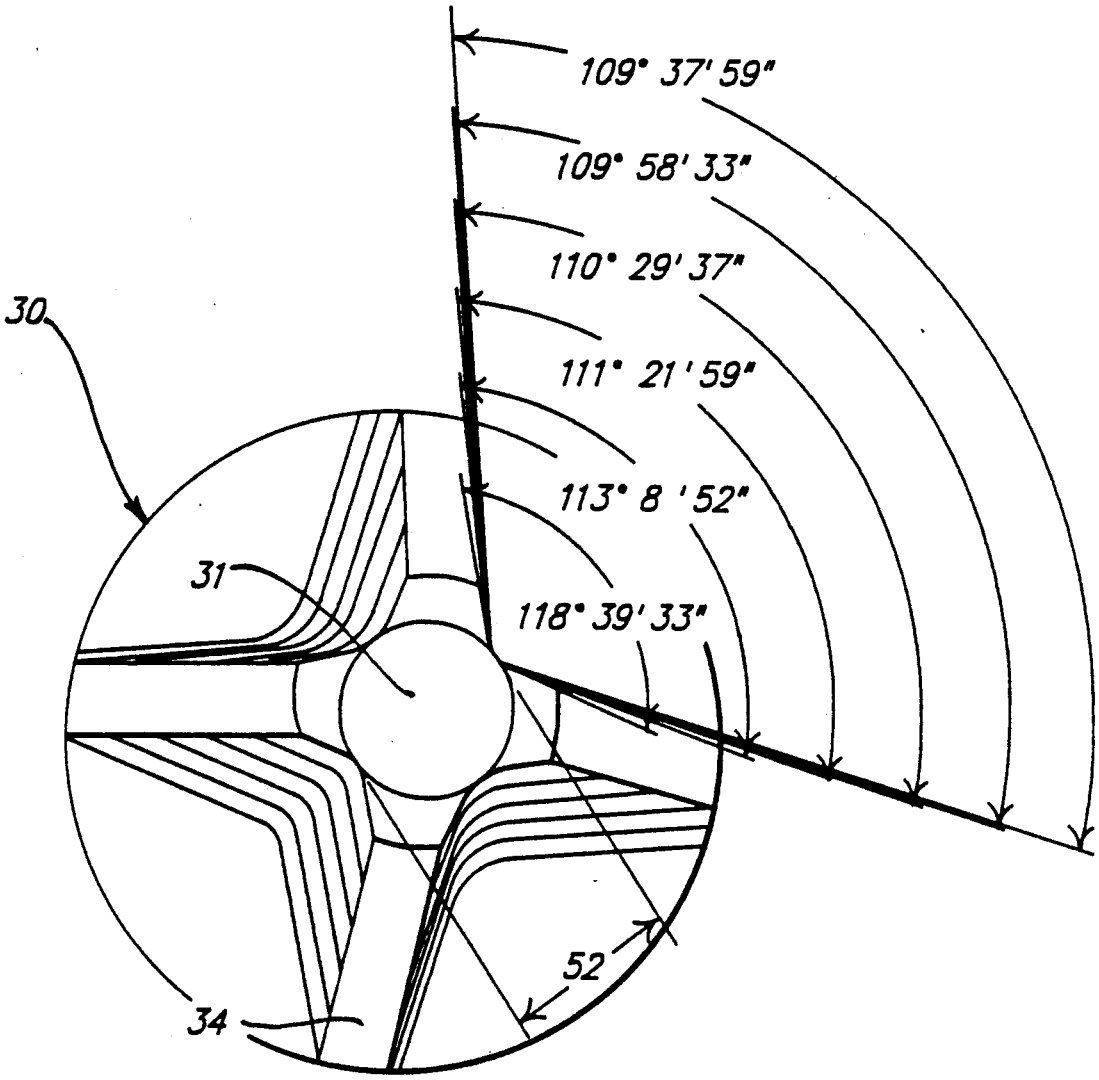
FIG. 30 is a simplified perspective view of the bottom end of another embodiment of the bit shown in FIG. 16.

Of the two embodiments illustrated in FIGS. 17 and 30, the embodiment illustrated in FIG. 30 has been found to produce the greatest benefits. This is due, it is believed, to the fact that the design shown in FIG. 30 places the initial lines of contact 46 on the side surfaces of the bit wings 32 closer to the roots 36 of the bit 30. Accordingly, torque can be applied over a greater area on the side surfaces of the bit wings 32. It is to be recognized, however, that other variations in dimension are possible while still achieving the primary objects of the present invention. For example, as it is important to ensure that a radial gap exists between the radially outward facing surfaces 34 of the bit wings 32 and the corresponding opposed faces 44 of the fastener recess 20 (FIG. 25), it is clearly possible to form the present screwdriver bit 30 shown in FIG. 27 with a bit wing angle less than the 26-degree 30-minute Phillips-standard without significantly reducing the effectiveness of the bit. In fact, sample screwdriver bits have been produced with bit wing angles as low as 18 degrees with acceptable results. However, it is equally apparent that a bit with too small of a wing angle will ultimately defeat the purpose of the invention by eliminating significant portions of the available driving surfaces on the sides of the bit wings.

In addition, it has also been determined that some variation and, in particular, a reduction in the root angle of the bit (for example, to 5 degrees) is possible without significantly affecting the performance of the present bit. However, once again, if too great a deviation from the Phillips-standard root angle is used, the initial lines of contact 46 between the bit winds and the recess are lost and the bit loses its precise "fit " within the recess of the fastener, thus precluding the bit from "holding" a standard Phillips fastener prior to installation into a workpiece.

For exemplary purposes, therefore, the following dimensions have been empirically determined to produce acceptable results within the teachings of the present invention. This data was achieved using tooling having the Phillips-standard 5-degree 30-minute root angle, a 0.015-inch root radius, and a nominal wing thickness of 0.025 inches at a radius of 0.10 inches from the center axis. All dimensions are given in inches.

| | Root Diameter | Wing Thickness |
|---|---|---|
| Phillips No. 1 | 0.039 ± 0.002 | 0.0205 ± 0.001 |
| Phillips No. 2 | 0.061 ± 0.002 | 0.025 ± 0.001 |
| Phillips No. 3 | 0.106 ± 0.002 | 0.033 ± 0.002 |

The "root diameter" dimension refers to the radial distance between the roots at the base of the bit and is designated in FIG. 30 by the numeral 52. The "wing thickness" dimension refers to the thickness of the bit wing at the Phillips-standard 26-degree 30-minute bit wing angle, or the "projected" thickness of the bit wing at that angle if the actual bit wing angle is less than the Phillips-standard. In other words, as previously noted, the width of the radially outward facing surfaces 34 of the bit wings 32 in the present invention remain substantially constant from the base 31 of the wing to the wing tip 35 (FIG. 16). However, this relationship only exists at the Phillips-standard bit wing angle of 26 degrees 30 minutes. Therefore, if, as suggested above, the present screwdriver bit 30 is formed with a bit wing angle less than the Phillips-standard—e.g. 20 degrees—the constant width relationship will not exist at the actual radially outward surfaces 34 of the bit wings 32 (i.e., at a 20-degree bit wing angle), but will exist if the bit wings are projected out to the Phillips-standard bit wing angle.

The included angles between the bit wings set forth in FIG. 30 correspond to the bit configuration that results using the nominal Phillips No. 2 dimensions set forth in the chart above. By varying the root diameter and wing thickness dimensions within the tolerance ranges provided, different sets of included angles will result.

From the above discussion, it will be appreciated that the screwdriver bit 30 according to the present invention is able to significantly reduce the cam-out force associated with a standard Phillips screwdriver bit 10 by preventing the radially outward facing bit wing surfaces 34 from contacting the recess 20 in the head 22 of the fastener 24. Due to the angle of these bit wing surfaces 34, the application of force along these surfaces is believed to be the greatest cause of cam-out in a standard Phillips design. Therefore, the present screwdriver bit 30 is capable of deforming the recess wings 21 in a Phillips-head fastener 24 to the degree illustrated in FIG. 26 before significant cam-out forces will be generated. At the stage illustrated in FIG. 26, torque is being applied along virtually the entire side surfaces of the bit wings 32 from the initial lines of contact 46 adjacent the root 36 of the bit to the outer radial edges 48 of the bit wings 32.

Finally, it will be appreciated that, in view of the radially symmetrical design of the invention, the present screwdriver bit 30 is capable of applying significantly greater torque loads than a standard Phillips bit in either rotational direction. THerefore, unlike certain existing modified Phillips designs which radially offset the bit wings and are, therefore, primarily useable in only one rotational direction, the present invention is equally useful for tightly setting standard Phillips screws and for "breaking free" and removing "frozen" Phillips fasteners.

While the above description constitutes the preferred embodiment of the invention, it will be appreciated that the invention is susceptible to modification, variation, and change without departing from the proper scope of fair meaning of the accompanying claims.

What is claimed is:

1. A driver for applying torque to a fastener having a standard Phillips cross-shaped recess formed in the head of the fastener, the standard Phillips cross-shaped recess comprising four equally radially spaced recess wings having side surfaces and outer radial surfaces, the outer radial surfaces thereof converging toward a common point at a predefined standard wing angle relative to the axis of the fastener, the side surfaces of adjoining recess wings defining a predefined standard included angle that remains substantially constant from the bottom of said recess wings to the top of said recess, and wherein the sidewalls of said recess wings are angled at a predefined standard root angle relative to said axis;

the driver having associated therewith an axis and including a bit portion symmetrical about any plane containing the axis of the driver and adapted for insertion into said recess comprising:

four bit wings having side surfaces and radially outward facing surfaces, the radially outward facing surfaces converging at an angle relative to the axis of said bit portion substantially equal to said predefined standard wing angle, and wherein the side surfaces of adjoining bit wings define a root that is oriented relative to said axis at an angle substantially equal to said standard root angle, and further wherein said side surfaces of adjoining bit wings define an included angle that increases progressively in the axial direction from a first angle at least as great as said standard included angle adjacent the base of said bit wings to a second greater included angle at an axially spaced distance therefrom, such that when said bit portion is inserted into the recess of a standard Phillips-head fastener, initial contact is created between the recess and said bit portion on the side surfaces of said bit wings.

2. The driver of claim 1 wherein the contact area between the recess and said bit portion expands progressively radially outwardly from the initial area of contact as the torque levels applied by said driver to said fastener increase.

3. The driver of claim 1 wherein said radially outward facing surfaces of said bit wings have a substantially uniform width from the base of said bit wings to the end of said taper.

4. The driver of claim 1 wherein a gap exists radially inward from the initial area of contact between the roots of said bit portion and the opposing surfaces of said recess when said bit portion is fully inserted into said recess.

5. The driver of claim 1 wherein the base of said bit portion is truncated.

6. The driver of claim 1 wherein said bit portion is symmetrical about any plane containing the axis of the river.

7. The driver of claim 3 wherein a gap exists between said radially outward facing surfaces of said bit wings and the opposing outer radial surfaces of said recess wings when said bit portion is fully inserted into said recess.

8. A driver for a standard Phillips-head fastener having a cross-shaped recess formed in the head thereof in accordance with the Phillips-standard wing angle, root angle, and included angle dimensions, the driver including a bit portion adapted for insertion into said recess and comprising four bit wings having radially outwardly facing surfaces converging toward a common point at approximately the Phillips-standard wing angle, the bit portion comprising:

generated side surfaces on said bit wings such that the side surfaces of adjoining bit wings define an included angle in a plane substantially normal to the axis of said bit portion that decreases in the axial direction from a first angle greater than the Phillips-standard included angle adjacent the base of said bit wings to a second angle greater than the Phillips-standard included angle adjacent the radially outer tip of said bit wings.

9. The driver of claim 8 wherein the included angle between the side surfaces of adjoining bit wings decreases progressively from said first angle to said second angle.

10. The driver of claim 7 wherein said driver has four bit wings and said bit wings are radially symmetrical such that equal levels of torque can be applied from said driver to the fastener in both rotational directions by all four bit wings.

11. The driver of claim 8 wherein said first angle is approximately equal to 119 degrees and said second angle is approximately equal to 110 degrees.

12. The driver of claim 8 wherein said bit wings define roots therebetween that are oriented relative to the axis of said bit at an angle substantially equal to the Phillips-standard root angle.

13. The driver of claim 12 wherein said bit portion is adapted to initially engage said recess at the side surfaces of said bit wings along lines of contact adjacent and substantially parallel to said roots.

14. The driver of claim 13 wherein a progressively increasing gap exists between the generated side surfaces of said bit wings and the corresponding side surfaces of said recess in a radially outward direction from said lines of contact when said bit portion is inserted into said recess.

15. The driver of claim 14 wherein the base of said bit portion is truncated.

16. The driver of claim 14 wherein said radially outward facing surfaces of said bit wings have a substantially uniform width.

17. The driver of claim 14 wherein the area of engagement between the recess and said bit expands progressively radially outwardly from said lines of contact as the torque levels applied by said driver to said fastener increases.

18. The driver of claim 14 wherein a gap exists between said radially outward facing surfaces of said bit wings and said opposing outer radial surfaces of said recess wings when said bit portion is fully inserted into said recess.

19. The driver of claim 14 wherein a gap exists radially inward from said lines of contact between the roots of said bit portion and the opposing surfaces of said recess when said bit portion is fully inserted into said recess.

20. A driver for a standard Phillips-head fastener having a cross-shaped recess formed in the head thereof defining recess wings having outer radial surfaces that are tapered toward a common point at a predefined standard wing angle relative to the axis of the fastener and sidewalls oriented at a predefined standard root angle relative to said axis such that the thickness of said recess wings expands in the axial direction from the bottom of the recess to the top of the recess; said driver including a bit portion adapted for insertion into said recess comprising:

four bit wings having radially outward facing surfaces that are tapered toward a common point at an angle substantially equal to said standard wing angle relative to the axis of said bit portion and wherein the thickness of said bit wings adjacent the roots of said bit wings increases gradually in the axial direction at an angle approximately equal to said standard root angle but remains substantially constant along said tapered radially outward facing surfaces.

21. The driver of claim 20 wherein a gap exists between said radially outward facing surfaces of said bit wings and said opposing outer radial surfaces of said recess wings when said bit portion is fully inserted into said recess.

22. The driver of claim 20 wherein a gap exists radially inward from said lines of contact between the roots of said bit portion and the opposing surfaces of said recess when said bit portion is fully inserted into said recess.

23. The driver of claim 20 wherein the base of said bit portion is truncated.

24. The driver of claim 20 wherein said bit wings are radially symmetrical such that equal levels of torque can be applied by said driver to the fastener in both rotational directions by all four bit wings.

25. The driver of claim 20 wherein said bit wings define roots therebetween that are oriented relative to the axis of said bit portion at an angle substantially equal to said standard root angle.

26. The driver of claim 25 wherein the side surfaces of adjoining recess wings in the standard Phillips-head fastener define a predefined Phillips-standard included angle that remains substantially constant from the bottom of said recess to the top of said recess, and further wherein the side surfaces of said bit wings of the driver comprise generated surfaces that define an included angle in a plane substantially normal to said bit portion axis that progressively decreases in the axial direction from a first angle greater than said Phillips-standard included angle adjacent the base of said bit wings to a second angle smaller than said first angle but still greater than said Phillips-standard included angle adjacent the radially outer tips of said bit wings.

27. The driver of claim 26 wherein said bit portion is adapted to engage said recess when said bit portion is inserted into said recess at the generated side surfaces of said bit wings along lines of contact adjacent and substantially parallel to said roots.

28. The driver of claim 27 wherein the area of engagement between the recess and said bit portion expands progressively radially outwardly from said lines of contact as the torque levels applied by said driver to said fastener increase.

29. The driver of claim 26 wherein said first angle is approximately equal to 119 degrees and said second angle is approximately equal to 110 degrees.

30. A driver for a standard Phillips-head fastener having a cross-shaped recess formed to a defined depth in the head thereof, the driver having associated therewith an axis and including a bit portion adapted for insertion into said recess comprising:

wing means symmetrical about any plane containing the axis of the river and having side surfaces defining roots therebetween for rotationally driving said fastener initially adjacent said roots along substantially the entire depth of said recess and progressively radially outward therefrom along said side surfaces as the torque levels applied by said driver to said fastener increase.

31. The driver of claim 30 wherein said wing means initially drive said fastener along lines of contact with said recess that are substantially parallel to said roots.

32. The driver of claim 30 wherein said wing means comprises four equally radially spaced bit wings defined by generated side surfaces that in turn define an included angle between adjoining bit wings that progressively increases in the axial direction from a first angle at least as great as the Phillips-standard included angle adjacent the base of the bit wings to a second greater included angle adjacent the radially outer tips of said bit wings.

33. The driver of claim 30 wherein said wing means comprises four equally radially spaced bit wings defined by generated side surfaces that in turn define an included angle between adjoining bit wings that progressively decreases in the axial direction from a first angle greater than the Phillips-standard included angle adjacent the base of said bit wings to a second angle smaller than said first angle but still greater than the Phillips-standard included angle adjacent the radially outer tips of said bit wings.

34. The driver of claim 33 wherein said first angle is approximately equal to 119 degrees and said second angle is approximately equal to 110 degrees.

35. The driver of claim 33 wherein the radially outwardly facing surfaces of said bit wings are tapered toward a common point at an angle relative to the axis of said bit portion substantially equal to the Phillips-standard wing angle.

36. The driver of claim 35 wherein said radially outward facing surfaces of said bit wings have a substantially uniform width.

37. The driver of claim 35 wherein the roots of said bit portion are oriented relative to said bit axis at an angle substantially equal to the Phillips-standard root angle.

38. The driver of claim 37 wherein the base of said bit portion is truncated.

39. The driver of claim 37 wherein a gap is exists between said radially outward facing surfaces of said bit wings and the opposing outer radial surfaces of said recess when said bit portion is fully inserted into said recess.

40. The driver of claim 37 wherein a gap exists between the root areas of said bit portion and the opposing surfaces of said recess when said bit portion is inserted into said recess.

41. A driver for a standard Phillips-head fastener having a cross-shaped recess formed in the head thereof, the driver having associated therewith an axis and including a bit portion symmetrical about any plane containing the axis of the driver and adapted for insertion into said recess comprising:

wing means having generated side surfaces and defining roots therebetween for rotationally driving said fastener on said side surfaces in the same manner in both rotational directions.

42. The driver of claim 41 wherein said wing means is adapted to rotationally drive said fastener in both rotational directions initially adjacent said roots and progressively radially outward therefrom along said side surfaces as torque levels applied by said driver to said fastener increase.

43. The driver of claim 42 wherein said wing means initially engages said recess and drives said fastener along lines of contact adjacent and substantially parallel to said roots.

44. The driver of claim 43 wherein said wing means comprises four equally radially spaced bit wings defined by generated side surfaces that in turn define an included angle between adjoining bit wings that progressively decreases from a first angle greater than the Phillips-standard included angle adjacent the base of said bit wings to a second angle smaller than said first angle but still greater than the Phillips-standard included angle adjacent the radially outer tips of said bit wings.

45. The driver of claim 44 wherein said first angle is approximately equal to 119 degrees and said second angle is approximately equal to 110 degrees.

46. The driver of claim 44 wherein said bit wings have radially outwardly facing surfaces that are tapered toward a common point at an angle relative to the axis of said driver substantially equal to the Phillips-standard wing angle.

47. The driver of claim 46 wherein said radially outward facing surfaces of said bit wings have a substantially uniform width.

48. The driver of claim 47 wherein the roots of said bit portion are oriented relative to said driver axis at an angle substantially equal to the Phillips-standard root angle.

49. The driver of claim 48 wherein a gap exists between said radially outward facing surfaces of said bit wings and the opposing outer radial surfaces of said recess when said bit portion is fully inserted into said recess.

50. The driver of claim 48 wherein a gap exists between the root areas of said bit portion and the opposing surfaces of said recess when said bit portion is inserted into said recess.

51. The driver of claim 48 wherein the base of said bit portion is truncated.

52. A driver for applying torque to a fastener having a standard Phillips cross-shaped recess formed in the head of the fastener, the standard Phillips cross-shaped recess comprising four equally radially spaced recess wings having side surfaces and outer radial surfaces, the outer radial surfaces thereof converging toward a common point at a predefined standard wing angle relative to the axis of the fastener, the side surfaces of adjoining recess wings defining a predefined standard included angle that remains substantially constant from the bottom of said recess wings to the top of said recess, and wherein the sidewalls of said recess wings are angled at a predefined standard root angle relative to said axis;

the driver having associated therewith an axis and including a bit portion symmetrical about any plane containing the axis of the driver and adapted for insertion into said recess comprising:

four bit wings having side surfaces and radially outward facing surfaces, the radially outward facing surface converging at an angle relative to the axis of said bit portion substantially equal to said predefined standard wing angle, and wherein the side surfaces of adjoining bit wings define a root that is oriented relative to said axis at an angle substantially equal to said standard root angle, and further wherein said bit wings are configured such that when said bit portion is inserted into the recess of a standard Phillips-head fastener, initial contact is created between the recess and said bit portion on the side surfaces of each of said bit wings along lines of contact adjacent and substantially parallel to said roots with a gradually increasing gap formed between the side surfaces of said bit wings and the corresponding side surfaces of said recess wings in a radially outward direction from said lines of contact.

53. The driver of claim 52 wherein the side surfaces of adjoining bit wings define an included angle that progressively decreases in the axial direction from a first angle greater than said predefined standard included angle adjacent the base of said bit wings to a second angle smaller than said first angle but still greater than said predefined standard included angle adjacent the radially outer tips of said bit wings.

54. The driver of claim 52 wherein the contact area between the recess and said bit portion expands progressively radially outwardly from said lines of contact as the torque levels applied by said driver to said fastener increase.

55. The driver of claim 52 wherein said radially outward facing surfaces of said bit wings have a substantially uniform width from the base of said bit wings to the end of said taper.

56. The driver of claim 52 wherein a gap exists radially inward from said lines of contact between the roots of said bit portion and the opposing surfaces of said recess when said bit portion is fully inserted into said recess.

57. The driver of claim 54 wherein said bit wings are configured so that all four bit wings rotationally drive the fastener in the same manner in both rotational direction.

58. The driver of claim 55 wherein a gap exists between said radially outward facing surfaces of said bit wings and said opposing outer radial surfaces of said recess wings when said bit portion is fully inserted into said recess.

59. The driver of claim 52 wherein the base of said bit portion is truncated.

60. A driver for a standard Phillips-head fastener having a cross-shaped recess formed in the head thereof, the driver having associated therewith an axis and including a bit portion symmetrical about any plane containing the axis of the driver and adapted for insertion into said recess comprising:

wing means having side surfaces and defining roots therebetween for rotationally driving said fastener in both rotational directions initially along lines of contact on said side surfaces adjacent and substantially parallel to said roots and over progressively radially outwardly expanding areas on said side surfaces as the torque levels applied by said driver to said fastener increase.

61. The driver of claim 60 wherein said wing means comprises four bit wings that are configured to rotationally drive the fastener in the same manner in both rotational directions.

62. The driver of claim 60 wherein said wing means comprises four equally radially spaced bit wings defined by generated side surfaces that in turn define an included angle between adjoining bit wings that progressively decreases from a first angle greater than the Phillips-standard included angle at the base of said bit wings to a second angle less than said first angle but still greater than the Phillips-standard included angle adjacent the radially outer tips of said bit wings.

63. The driver of claim 62 wherein said first angle is approximately equal to 119 degrees and said second angle is approximately equal to 110 degrees.

64. The driver of claim 62 wherein said wing means further has radially outwardly facing surfaces that are tapered toward a common point at an angle relative to the axis of said bit portion substantially equal to the Phillips-standard wing angle.

65. The driver of claim 64 wherein the roots of said bit portion are oriented relative to said bit axis at an angle substantially equal to the Phillips-standard root angle.

66. The driver of claim 65 wherein said cross-shaped recess has radially outward facing surfaces and further wherein a gap exists between said radially outward facing surfaces of said bit wings and the opposing outer radial surfaces of said recess when said bit portion is fully inserted into said recess.

67. The driver of claim 65 wherein a gap exists between the root areas of said bit portion and the opposing surfaces of said recess when said bit portion is inserted into said recess.

68. The driver of claim 65 wherein the base of said bit portion is truncated.

69. The method of applying torque to a standard Phillips-head fastener having a standard Phillips cross-shaped recess formed in the head thereof, including the steps of:

inserting into said standard Phillips-head recess the bit portion of a driver having four radially symmetrical bit wings that are adapted to engage said recess along lines of contact on the side surfaces of said bit wings adjacent and substantially parallel to the roots of said adjoining bit wings, and rotating said driver so that torque is initially applied to said fastener along said lines of contact.

70. The method of claim 69 wherein each of said four bit wings drives the fastener in the same manner in both rotational directions.

71. The method of claim 69 further including the step of progressively expanding the areas of contact between said bit portion and said recess in a radially outward direction over said side surfaces of said bit wings as the level of torque applied by said driver to said fastener in a first rotational direction increases.

72. The method of claim 71 further including the step of progressively expanding the areas of contact between said bit portion and said recess in a radially outward direction over said side surfaces of said bit wings as the level of torque applied by said driver to said fastener in a second opposite rotational direction increases.

* * * * *

UNITED STATES PATENT AND TRADEMARK OFFICE

CERTIFICATE OF CORRECTION

PATENT NO. : 4,998,454

DATED : March 12, 1991

INVENTOR(S) : Peter C. Chaconas et al.

It is certified that error appears in the above-identified patent and that said Letters Patent is hereby corrected as shown below:

Column 9, line 7, claim 6, "river" should be --driver--.

Column 9, line 35, claim 10, "7" should be --8--.

Column 9, line 66, claim 17, "increases" should be --increase--.

Column 11, line 15, claim 30, "river" should be --driver--.

Column 11, line 62, claim 39, after "gap", delete "is".

Column 13, line 9, claim 52, "surface" should be --surfaces--.

Column 13, lines 50 - 51, claim 57, "direction" should be --directions--.

Column 14, line 13, claim 62, after "angle", delete "at" and insert --adjacent--.

Signed and Sealed this

Twenty-second Day of September, 1992

*Attest:*

DOUGLAS B. COMER

*Attesting Officer*

*Acting Commissioner of Patents and Trademarks*